US006297568B1

(12) United States Patent
Kempinski

(10) Patent No.: US 6,297,568 B1
(45) Date of Patent: Oct. 2, 2001

(54) INDUCTIVE IGNITION CIRCUIT

(75) Inventor: Steve J. Kempinski, Seneca, SC (US)

(73) Assignee: Champion Aerospace Inc., Liberty, SC (US)

( * ) Notice: Subject to any disclaimer, the term of this patent is extended or adjusted under 35 U.S.C. 154(b) by 0 days.

(21) Appl. No.: 09/472,370

(22) Filed: Dec. 23, 1999

Related U.S. Application Data

(60) Provisional application No. 60/113,438, filed on Dec. 23, 1998.

(51) Int. Cl.[7] ..... H01T 15/00

(52) U.S. Cl. ..... 307/125; 123/623; 327/443; 361/253

(58) Field of Search ..... 307/125, 104; 327/440, 530, 108, 443; 361/253, 263; 123/644, 623

(56) References Cited

U.S. PATENT DOCUMENTS

| | | | | |
|---|---|---|---|---|
| 2,981,865 | | 4/1961 | Fernbach . | |
| 3,019,782 | | 2/1962 | Kuritza . | |
| 4,036,201 | | 7/1977 | Burson . | |
| 4,188,930 | | 2/1980 | Santi . | |
| 4,261,025 | * | 4/1981 | Chafer et al. | 327/530 |
| 4,270,509 | | 6/1981 | Tharman . | |
| 4,288,834 | | 9/1981 | Burson . | |
| 4,403,593 | | 9/1983 | Piteo . | |
| 4,487,191 | | 12/1984 | Piteo . | |
| 4,738,239 | | 4/1988 | Haines et al. . | |
| 4,799,471 | * | 1/1989 | Lasagna et al. | 123/663 |
| 4,817,577 | | 4/1989 | Dykstra . | |
| 4,833,369 | | 5/1989 | White . | |
| 4,918,569 | | 4/1990 | Maeda et al. . | |
| 5,056,496 | | 10/1991 | Morino et al. . | |
| 5,065,073 | | 11/1991 | Frus . | |
| 5,139,004 | | 8/1992 | Gose et al. . | |
| 5,148,084 | | 9/1992 | Frus . | |
| 5,245,252 | | 9/1993 | Frus et al. . | |
| 5,377,652 | | 1/1995 | Noble et al. . | |
| 5,392,753 | | 2/1995 | Burson et al. . | |
| 5,399,942 | | 3/1995 | Frus . | |
| 5,411,006 | | 5/1995 | Noble et al. . | |
| 5,513,619 | | 5/1996 | Chen et al. . | |
| 5,544,633 | | 8/1996 | Mottier et al. . | |
| 5,548,471 | * | 8/1996 | Roederer | 361/253 |
| 5,558,071 | | 9/1996 | Ward et al. . | |
| 5,561,350 | | 10/1996 | Frus et al. . | |
| 5,587,630 | | 12/1996 | Dooley . | |
| 5,630,384 | | 5/1997 | Mottier et al. . | |
| 5,656,966 | * | 8/1997 | Wilmot et al. | 327/440 |
| 5,755,199 | | 5/1998 | Costello et al. . | |

* cited by examiner

*Primary Examiner*—Albert W. Paladini
(74) *Attorney, Agent, or Firm*—Reising, Ethington, Barnes, Kisselle, Learman & McCulloch, P.C.

(57) ABSTRACT

An inductive ignition circuit (10) especially adapted for use with micro-turbine and other small-sized turbine engines such as are used in electric generators. The inductive ignition circuit (10) includes a flyback transformer (14), a drive circuit (16) for energizing the primary (22) of the transformer (14), and a control circuit (18) that temporarily disables the drive circuit (16) once the transformer primary (22) has been sufficiently energized. The drive circuit includes a switching transistor (20) which is biased on to draw current through the primary (22). The control circuit (18) includes two feedback circuits (42,44), one of which initiates disabling of the transistor (20) to cause the transformer flyback and the second of which sets the spark rate. The first feedback circuit (42) monitors the primary current and disables the transistor (20) once the current exceeds a pre-selected level. The second feedback circuit (44) uses a portion of the flyback energy obtained via a feedback winding (30) to maintain the transistor disabled for a period of time that can be selected over a wide range of values. The feedback winding (30) is used to provide positive bias to the transistor (20) during switching on of the transistor and is used by the second feedback circuit (44) during flyback to provide charging current to an RC timer circuit (64) in the second feedback circuit. This timer circuit (64) includes a capacitor (68) which is used to hold the transistor (20) off until the capacitor (68) has discharged below a pre-selected level.

20 Claims, 3 Drawing Sheets

INDUCTIVE IGNITION CIRCUIT

This application claims the priority of U.S. Provisional Application No. 60/113,438, filed Dec. 23, 1998.

TECHNICAL FIELD

This invention relates generally to ignition circuits used in fuel-powered engines and generators and, in particular, relates to such circuits used for turbine engines and generators.

BACKGROUND OF THE INVENTION

Traditional turbine engine ignition systems utilize a high energy capacitive discharge circuit which provides an ignition spark that typically delivers between one and five joules of energy at a rate of roughly ten sparks per second. These relatively high amounts of spark energy are needed to ignite the jet fuel, which by design has a relatively low flammability that is closer to kerosene than gasoline. As the turbine begins to spin and the fuel enters the system, the air/fuel ratio moves through a window in which the ratio is optimal for ignition. That is, the air/fuel ratio changes from being too lean for ignition to being too rich, and it is at the cross-over between these two states that conditions are optimal for ignition. In the typical large turbine engine, the air/fuel mixture moves through this window rather slowly. Accordingly, the relatively low spark rate (e.g., ten sparks per second) provided by the traditional capacitive discharge ignition systems is suitable for catching the air/fuel mixture within this window.

Apart from capacitive discharge circuits, various inductive ignition circuits have also been proposed for turbine and internal combustion engines. These systems generally utilize a transformer or other inductive device to store energy used in generating the spark. See, for example, U.S. Pat. No. 5,139,004, issued Aug. 18, 1992 to M.W. Gose et al., which discloses an inductive ignition circuit for an internal combustion engine. The ignition circuit utilizes a drive transistor to control current flow through the primary of a step-up transformer. The drive transistor is switched on and off in synchronism with rotation of the engine's crankshaft. A resistor in series with the primary winding and drive transistor is used to sense current through the primary and is connected to the transistor's drive circuit to bias the drive transistor into a current-limiting mode when the primary winding current increases to a predetermined level. The drive circuit includes an RC timing circuit that is used to prevent the drive transistor from being biased back on by spurious noise prior to the succeeding timing pulse from the crankshaft's position sensor. The signal from this timing circuit is provided to a comparator circuit along with a reference voltage and the comparator output is used to hold the drive transistor off until the signal from the timing circuit falls below the reference voltage.

Another such inductive ignition circuit is disclosed in U.S. Pat. No. 4,738,239, issued Apr. 19, 1988 to D. L. Haines et al. The circuit includes a high side connected drive transistor that is switched on and off by a signal generator. The transistor is turned off by switching its gate to ground. During flyback of the transformer, the voltage at the transistor's source is driven negative. To prevent the transistor from switching back on, a separate transistor is used to clamp the gate of the transistor to its source during flyback of the transformer. As with the Gose et al. circuit, the spark rate is determined based on crankshaft position.

Ignition circuits that do not utilize flyback for spark generation have also been utilized. See, for example, U.S. Pat. No. 5,587,630, issued Dec. 24, 1996 to K. A. Dooley, which discloses a continuous plasma ignition system that utilizes an LC resonant circuit operating at between 10–30 KHz. The circuit includes a transformer and drive transistor which is switched either by a timer circuit having a frequency that is set by an RC circuit or by closed loop feedback from the transformer secondary using a voltage controlled oscillator to drive the circuit towards resonance. U.S. Pat. No. 4,918,569, issued Apr. 17, 1990 to T. Maeda et al., discloses a forward type ignition circuit having a high self-resonance frequency which provides a high voltage output with a short rise time. The drive circuit includes a transformer and a transistor for switching current through the transformer primary. A sense resistor in the ground path of the secondary provides a detection signal which is fed to a control circuit that switches off the drive transistor when the current through the secondary becomes sufficiently high.

Various hybrid ignition systems have been proposed in which an inductive storage device is used in combination with a transformer or capacitor to provide the spark energy. For example, U.S. Pat. No. 5,065,073, issued Nov. 12, 1991 to J. R. Frus, discloses a capacitive discharge ignition circuit which includes a dc-dc converter having a flyback transformer that is used to charge the circuit's main storage capacitor. The dc-dc converter uses a feedback winding which supplies positive bias to its drive transistor during turn-on of the transistor. A sense resistor in the primary winding current path is used to initially switch the transistor back off once the current through the primary gets sufficiently high. Thereafter, flyback energy from the feedback winding provides negative bias to hold the drive transistor off during flyback. Spark rate control is provided by way of a separate timing circuit that provides a disable signal to the drive transistor to maintain it in an off state for a period of time after flyback of the transformer.

The foregoing ignition circuits have been designed primarily for use in automotive internal combustion engines and in aircraft turbine engines. More recently, however, smaller turbine systems that are powered by natural gas and other nontraditional fuel sources have begun to appear. Not only can these systems be ignited with less spark energy than that supplied by traditional capacitive discharge ignition systems, but also they may move through their optimal air/fuel mixture window very quickly, especially in micro-turbine systems such as are sometimes used in electric generators. Consequently, the traditional capacitive discharge ignition systems can be too slow to provide optimal ignition of the turbine system. While some of the ignition systems described above can achieve the necessary spark rates and, in the case of the Dooley system, can provide a continuous plasma arc, most of these systems do not provide closed-loop spark rate control that is selectable over a wide range.

Accordingly, it is an object of the invention to provide a low-cost inductive ignition circuit that provides reliable ignition of the newer types of small turbine engines such as micro-turbines used in electric generators.

SUMMARY OF THE INVENTION

In accordance with the present invention, there is provided an inductive ignition circuit especially adapted for use with micro-turbine and other small-sized turbine engines such as are used in electric generators. The inductive ignition circuit includes a transformer, a drive circuit for energizing the primary of the transformer, and a control circuit that temporarily disables the drive circuit once the transformer primary has been sufficiently energized. The drive circuit includes a control input that is used to switch the drive circuit between a first state in which it causes current flow through the transformer primary and a second state in which substantially no current flows through the primary. The control circuit is connected to the control input of the drive circuit and is operable to provide a disable signal once the primary has been energized enough to produce sufficient spark energy at the transformer secondary.

Preferably, the control circuit includes two feedback circuits, one of which initiates disabling of the drive circuit to cause the transformer flyback and the second of which uses a portion of the flyback energy obtained via a feedback winding to maintain the drive circuit disabled for a period of time following the transformer flyback. This period of time determines the spark rate of the circuit and can be selected over a wide range, either by use of an adjustable element in the second feedback circuit or by selection of suitable component values as a part of the final circuit design in accordance with the requirements of the particular application for which the ignition circuit is to be used.

Preferably, the first feedback circuit monitors the primary current and disables the drive circuit once the current exceeds a pre-selected level. The feedback winding is preferably used to provide positive bias to the drive circuit during switching on of the drive circuit and is also preferably used during flyback to provide charging current to an RC timer circuit in the second feedback circuit. This timer circuit includes a capacitor which is used to hold the drive circuit off until the capacitor has discharged below a preselected level.

BRIEF DESCRIPTION OF THE DRAWINGS

A preferred exemplary embodiment of the present invention will hereinafter be described in conjunction with the appended drawings, wherein like designations denote like elements, and.

DETAILED DESCRIPTION OF THE PREFERRED EMBODIMENTS

Figure 1:
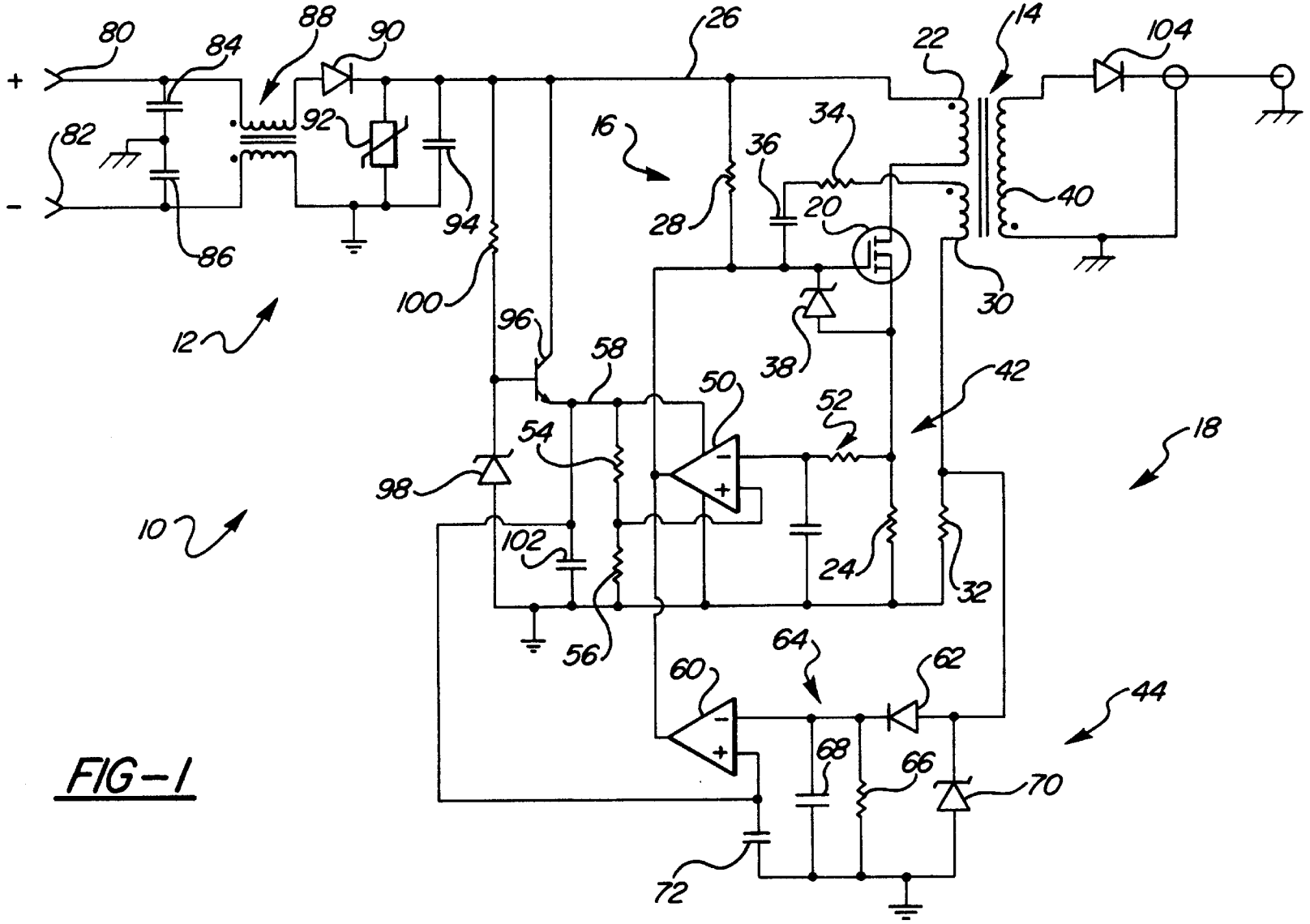
FIG. 1 is a schematic of a preferred embodiment of an inductive ignition circuit constructed in accordance with the present invention.

Referring to FIG. 1, there is shown an inductive ignition circuit 10 such as might be used in a turbine generator fueled by natural gas. In general, ignition circuit 10 comprises an input filter 12, a transformer 14, a drive circuit 16, and a control circuit 18. As will be described below, upon application of power to input filter 12, drive circuit 16 turns on, causing current flow through transformer 14. Once the current flow increases above a pre-selected amount, control circuit 18 generates a disable signal that temporarily shuts off drive circuit 16, causing transformer 14 to flyback and produce a high voltage output that is supplied to a spark gap (not shown) for ignition of the generator. Once the disable signal is removed by control circuit 18, drive circuit 16 turns on again and the cycle repeats.

More specifically, drive circuit 16 includes a switching transistor in the form of an n-channel MOSFET 20 that has its drain connected in series with a primary winding 22 of transformer 14 and its source connected to ground through a current sensing resistor 24. The upper end of primary winding 22 is connected to a d.c. supply rail 26. The gate of transistor 20 comprises a control input of the drive circuit 16 and is connected via a pull-up resistor 28 to supply rail 26. Positive feedback is supplied to the gate of transistor 20 using a feedback winding 30 of transformer 14 that has one of its ends connected to ground via a second current sensing resistor 32 and has its other end connected to the gate of transistor 20 via a series connected feedback resistor 34 and capacitor 36. The gate of transistor 20 is also connected to the output of control circuit 18 which is operable to periodically disable operation of drive circuit 16 using a disable signal that, in the illustrated embodiment, is an active low signal that is produced by pulling the gate voltage down to ground.

As will be appreciated by those skilled in the art, in the absence of a disable signal from control circuit 18, pull-up resistor 28 causes transistor 20 to turn on. As current begins to flow through the primary 22, additional current is supplied to the gate of transistor 20 by feedback winding 30, causing transistor 20 to fully switch on. To protect against large transient voltages appearing at the gate of transistor 20, a 5v zener diode 38 can be connected between the gate and source of transistor 20, as shown. As the current through the primary 22 increases, so does the voltage appearing across the current sensing resistor 24. This voltage is monitored by control circuit 18 and, upon reaching a pre-selected magnitude, causes control circuit 18 to generate its disable signal which pulls the gate of transistor 20 to ground, thereby switching off transistor 20 and abruptly cutting off current flow through the primary 22. The magnetic field of transformer 14 then collapses quickly, causing an induced voltage of opposite polarity to appear across the feedback winding 30 and secondary winding 40 of transformer 14. This flyback of the transformer causes current flow through resistor 32 which is sensed by control circuit 18 and used to temporarily maintain drive circuit 16 in its off state. At the same time, the flyback of the transformer 14 causes a high voltage to appear across the secondary 40, with the magnitude of the voltage being determined by the turns ratio between the transformer primary and secondary.

With continued reference to FIG. 1, the construction and operation of control circuit 18 will now be described. Control circuit 18 includes a first feedback circuit 42 and a second feedback circuit 44, both of which are connected to the control input of drive circuit 16 (i.e., the gate of transistor 20). In general, these feedback circuits are used to temporarily shut off drive circuit 16 after the current through the primary 22 of transformer 14 ramps up to the desired level. These feedback circuits control drive circuit 16 by pulling the voltage at the gate of transistor 20 down to ground. Once they both release their hold on the gate, transistor 20 will switch back on due to pull-up resistor 28. Thus, the ignition circuit 10 will oscillate at a frequency that is dependent primarily on the amount of time that transistor 20 is held in its off state by the feedback circuits 42, 44. This frequency determines the spark rate of the ignition circuit.

Feedback circuit 42 is used to initially shut off operation of drive circuit 16 when the current through the primary 22 reaches the desired level, whereas feedback circuit 44 is used to maintain drive circuit 16 off until sometime after dissipation of the energy stored in the transformer's magnetic field. Feedback circuit 42 includes a comparator 50 having its inverting input coupled via an RC low pass filter 52 to the top of current sensing resistor 24. The low pass filter 52 is used to filter out high frequency signals greater than about 1 MHz that appear across resistor 24. The non-inverting input of comparator 50 is connected to a reference voltage that is provided by a voltage divider consisting of a pair of resistors 54, 56 that are connected between a 6v regulated voltage supply rail 58 and ground. The open-collector output of comparator 50 is connected directly to the gate of transistor 20.

Feedback circuit 44 also includes a comparator 60 having its output connected to the gate of transistor 20. The inverting input of comparator 60 is coupled to the top of current sensing resistor 32 via a steering diode 62 and an RC timing circuit 64. This timing circuit includes a resistor 66 and capacitor 68 connected in parallel between the inverting input and ground. A 15v zener diode 70 is connected across the sense resistor 32 to protect comparator 60 against large transient voltages. The non-inverting input of comparator 60 is connected to the regulated voltage supply rail 58 with a filter capacitor 72 connected at the non-inverting input to filter out noise.

In operation, both comparators 50, 60 provide a high impedance output that does not affect the operation of drive circuit 16 as it begins to turn transistor 20 on. As the current through the primary 22 ramps up, so does the voltage across sense resistor 24 until the point at which this voltage becomes greater than the reference voltage at the non-inverting input of comparator 50. At this point, the output of comparator 50 goes to ground, turning off transistor 20 and abruptly stopping current flow through the primary 22. Feedback circuit 44 is then used to temporarily hold drive circuit 16 in its off state. In particular, once transistor 20 is switched off, the polarity in the feedback winding 30 reverses due to the transformer flyback, thereby driving current through current sensing resistor 32 and creating a positive voltage across the resistor which is applied to the inverting input of comparator 60 where it charges up capacitor 68. Once the flyback energy from feedback winding 30 charges capacitor 68 to a voltage that is greater than the regulated supply voltage, the output of comparator 60 also grounds the gate of transistor 20, thereby maintaining it in its off state. Once all of the stored energy within transformer 14 is dissipated, comparator 60 maintains the gate of transistor 20 at ground until capacitor 68 has discharged through resistor 66 to the point at which the voltage on capacitor 68 falls below the regulated supply voltage. Thereafter, transistor 20 begins to turn on again due to pull-up resistor 28 and the cycle repeats. As will be appreciated, this arrangement provides an inductive ignition circuit which provides periodic spikes of high voltage for spark ignition at a rate which is selectable over a wide range using resistor 66 and capacitor 68. For smaller turbine systems in which the optimal ignition window is relatively short, spark rates of 200 sparks per second or more can be obtained by suitable selection of the values of resistor 66 and capacitor 68.

Input filter 12 includes a pair of input terminals 80, 82 that nominally receive 12vdc. The input filter comprises a conventional common mode filter having a pair of input capacitors 84, 86 and a transformer 88. Capacitors 84, 86 are each connected between the chassis ground and a respective one of the input terminals 80, 82. An input diode 90 provides reverse polarity protection in the event that the circuit is connected backwards to the batteries or other power supply. The input filter 12 also includes a transient spike protector 92 and a relatively large storage capacitor 94 connected between the supply rail 26 and ground. The regulated voltage supply 58 is provided using a transistor 96 having its collector connected to supply rail 26 and its emitter connected to supply current to the voltage supply node 58. A 6.8v zener diode 98 connected between the base of transistor 96 and ground sets the regulated voltage level using voltage fed from supply rail 26 through a resistor 100. A large storage capacitor 102 is connected between the voltage supply node 58 and ground to smooth and filter the voltage at node 58. At the secondary of transformer 14, a diode 104 can be used to prevent a short at the output from being reflected back to the primary side of transformer 14.

Preferably, MOSFET 20 can be a IRF640, manufactured by International Rectifier. Comparators 50 and 60 can each be one half of an LM2903D, manufactured by National Semiconductor. Preferably, transformer 14 is wound on a steel laminate core and has 20 turns of #18 wire for its primary, 27 turns of #26 wire for its feedback, and 3057 turns of #36 wire for its secondary. A suitable transformer can be obtained from Magnetek-Triad.

Figure 2:
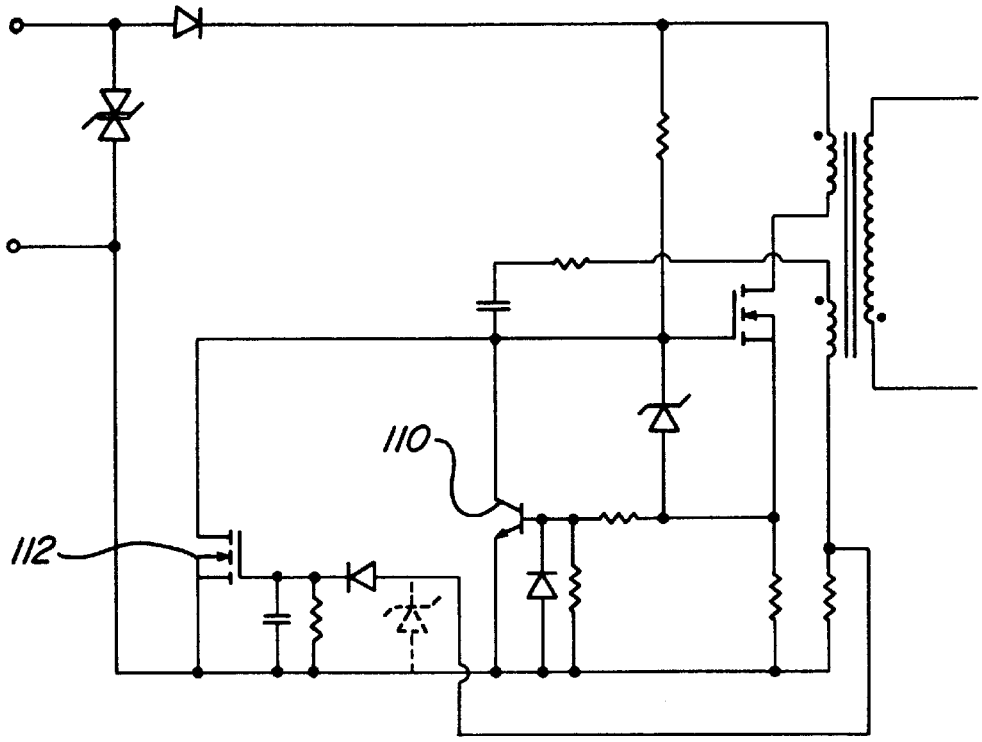
FIG. 2 is a schematic of a second embodiment of an inductive ignition circuit of the present invention.
Figure 3:
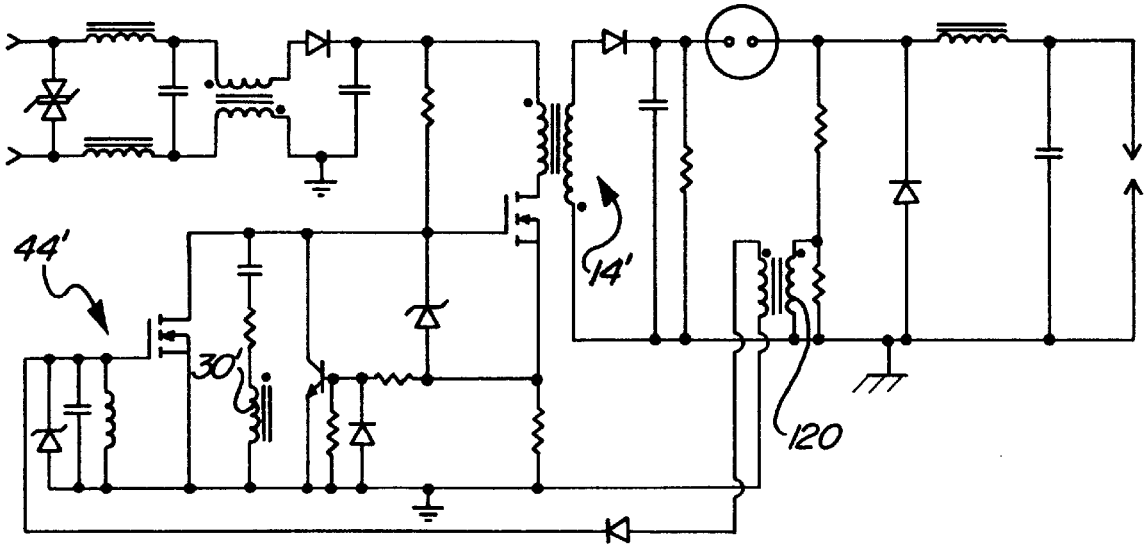
FIG. 3 is a schematic of a third embodiment of an inductive ignition circuit of the present invention.

Referring now briefly to FIG. 2, another embodiment is shown which operates in a similar manner to that of FIG. 1, except that transistors 110, 112 are used in the control circuit in place of comparators 50, 60. FIG. 3 is similar to that of FIG. 2, except that the feedback circuit 44' receives its input from a transformer 120 on the secondary of transformer 14' rather than from the feedback winding 30' of transformer 14'.

Figure 4:
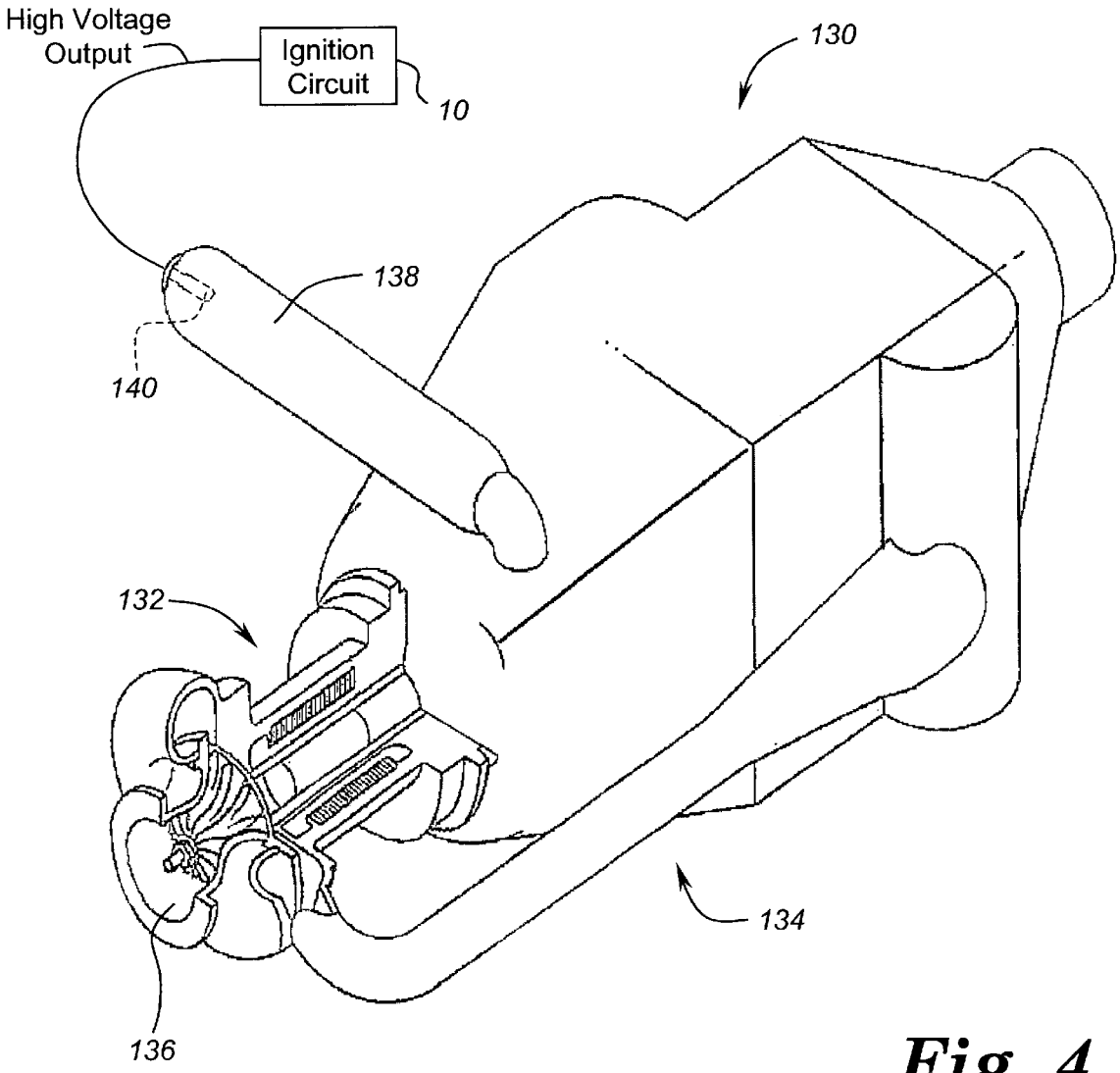
FIG. 4 is a partially diagrammatic and partially perspective view of an electric generator utilizing the inductive ignition circuit of FIG. 1.

Referring now to FIG. 4, there is shown an electric generator 130 which includes the inductive ignition circuit 10 of FIG. 1. With the exception of circuit 10, generator 130 can be a conventional fuel-powered turbo-generator that includes a permanent magnet generator section 132 driven by a turbine engine 134. Generator section 132 is shown cut-away and is located near the inlet 136 of electric generator 130. The turbine engine 134 can be a micro-turbine engine having a combustor 138 which includes an igniter plug 140 that is wired or otherwise coupled to ignition circuit 10 to receive the spark energy produced by the circuit. The generator 130 along with its circuit 10 can be mounted within an enclosure (not shown) for safety and protection of the generator.

It will thus be apparent that there has been provided in accordance with the present invention an inductive ignition circuit which achieves the aims and advantages specified herein. It will of course be understood that the foregoing description is of a preferred exemplary embodiment of the invention and that the invention is not limited to the specific embodiment shown. Various changes and modifications will become apparent to those skilled in the art. For example, the functions performed by feedback circuits 42, 44 can be implemented by a single feedback circuit that shuts off drive circuit 16 for a selected period of time following sufficient energization of primary 22, with the period of time being long enough to permit transformer 14 to dissipate its stored energy through the secondary's high voltage output and short enough to give the spark rate desired for a particular application. All such variations and modifications are intended to come within the scope of the appended claims.

I claim:

1. An inductive ignition circuit, comprising:

a transformer having a primary winding, a feedback winding, and a secondary winding, with said secondary winding having a high voltage output;

a drive circuit for said transformer primary winding, said drive circuit having an output coupled to said primary winding and having at least one control input for selectively enabling or disabling operation of said drive circuit, said drive circuit being switchable between a first state in which current flows through said primary winding, and a second state in which substantially no current flows through said primary winding, wherein said drive circuit is operable in said first state in the absence of a disable signal on said control input and is switched into said second state in response to receiving a disable signal on said control input; and a control circuit coupled between said feedback winding and said control input of said drive circuit, said control circuit being operable to temporarily provide a disable signal on said control input following operation of said drive circuit in said first state;

wherein said feedback winding has first and second leads with said first lead being connected to said drive circuit to provide positive feedback to said drive circuit and said second lead being connected to said control circuit.

2. An inductive ignition circuit, comprising:

a transformer having a primary winding, a feedback winding, and a secondary winding, with said secondary winding having a high voltage output;

a drive circuit for said transformer primary winding, said drive circuit having an output coupled to said primary winding and having at least one control input for selectively enabling or disabling operation of said drive circuit, said drive circuit being switchable between a first state in which current flows through said primary winding, and a second state in which substantially no current flows through said primary winding, wherein said drive circuit is operable in said first state in the absence of a disable signal on said control input and is switched into said second state in response to receiving a disable signal on said control input; and a control circuit coupled between said feedback winding and said control input of said drive circuit, said control circuit being operable to temporarily provide a disable signal on said control input following operation of said drive circuit in said first state;

wherein said control circuit comprises:

a first feedback circuit coupled to said control input of said drive circuit, said first feedback circuit being operable to generate a disable signal on said control input during operation of said drive circuit in said first state, whereby said drive circuit switches to said second state following operation of said drive circuit in said first state; and a second feedback circuit coupled between said feedback winding and said control input of said drive circuit, said second feedback circuit being operable in response to flyback energy supplied by said feedback winding to temporarily hold said drive circuit in said second state.

3. An ignition circuit as defined in claim 2, wherein said first feedback circuit further comprises a comparator that is connected in circuit to receive as inputs a reference voltage and a voltage indicative of the amount of current flowing through said primary, said first feedback circuit being operable to generate its disable signal in response to the current flowing through said primary winding increasing above a selected amount.

4. An ignition circuit as defined in claim 2, wherein said second feedback circuit further comprises a comparator that is connected in circuit to receive as inputs a reference voltage and a feedback signal from said feedback winding, said second feedback circuit being operable to generate its disable signal in response to the flyback energy supplied by said feedback winding.

5. An ignition circuit as defined in claim 4, wherein said second feedback circuit includes a timing circuit having a resistor and a capacitor, wherein said second feedback circuit generates its disable signal for a period of time that is dependent upon the values of said resistor and said capacitor.

6. An inductive ignition circuit, comprising:

a transformer having a primary winding, a feedback winding, and a secondary winding, with said secondary winding having a high voltage output;

a drive circuit for said transformer primary winding, said drive circuit having an output coupled to said primary winding and having at least one control input for selectively enabling or disabling operation of said drive circuit, said drive circuit being switchable between a first state in which current flows through said primary winding, and a second state in which substantially no current flows through said primary winding, wherein said drive circuit is operable in said first state in the absence of a disable signal on said control input and is switched into said second state in response to receiving a disable signal on said control input; and a control circuit coupled between said feedback winding and said control input of said drive circuit, said control circuit being operable to temporarily provide a disable signal on said control input following operation of said drive circuit in said first state;

wherein said drive circuit is operable to provide spark energy to said secondary winding by flyback of said transformer resulting from switching of said drive circuit from said first state to said second state.

7. An ignition circuit as defined in claim 6, wherein said feedback winding has a first end coupled to said drive circuit to provide current to said control circuit during switching of said drive circuit from said second state to said first state, and wherein said feedback winding further includes a second end coupled to said control circuit to provide current to said control circuit during flyback of said transformer.

8. An ignition circuit as defined in claim 6, wherein said feedback winding provides flyback energy to said control circuit during flyback of said transformer.

9. An ignition circuit as defined in claim 8, wherein said control circuit is operable to store at least some of the flyback energy and to use the stored flyback energy to hold said drive circuit in said second state for a period of time after flyback of said transformer.

10. An inductive ignition circuit, comprising:

a transformer having a primary winding, a feedback winding, and a secondary winding, with said secondary winding having a high voltage output;

a drive circuit for said transformer primary winding, said drive circuit having an output coupled to said primary winding and having at least one control input for selectively enabling or disabling operation of said drive circuit, said drive circuit being switchable between a first state in which current flows through said primary winding, and a second state in which substantially no current flows through said primary winding, wherein said drive circuit is operable in said first state in the absence of a disable signal on said control input and is switched into said second state in response to receiving a disable signal on said control input; and a control circuit coupled between said feedback winding and said control input of said drive circuit, said control circuit being operable to temporarily provide a disable signal on said control input following operation of said drive circuit in said first state;

wherein said control circuit includes a component coupled to receive a feedback signal from said feedback winding, said component having a value that determines a spark rate for said ignition circuit using said feedback signal, whereby said control circuit provides closed-loop control of the spark rate.

11. A turbine engine, comprising:

a micro-turbine engine having an igniter, and an inductive ignition circuit coupled to said igniter to provide spark energy to said igniter for use in igniting fuel within said micro-turbine engine, said inductive ignition circuit comprising:

a transformer having a primary winding, a feedback winding, and a secondary winding, with said secondary winding having a high voltage output;

a drive circuit for said transformer primary winding, said drive circuit having an output coupled to said primary winding and having at least one control input for selectively enabling or disabling operation of said drive circuit, said drive circuit being switchable between a first state in which current flows through said primary winding, and a second state in which substantially no current flows through said primary winding, wherein said drive circuit is operable in said first state in the absence of a disable signal on said control input and is switched into said second state in response to receiving a disable signal on said control input; and a control circuit coupled between said feedback winding and said control input of said drive circuit, said control circuit being operable to temporarily provide a disable signal on said control input following operation of said drive circuit in said first state;

wherein said feedback winding has first and second leads with said first lead being connected to said drive circuit to provide positive feedback to said drive circuit and said second lead being connected to said control circuit.

12. A turbine engine, comprising:

a micro-turbine engine having an igniter, and an inductive ignition circuit coupled to said igniter to provide spark energy to said igniter for use in igniting fuel within said micro-turbine engine, said inductive ignition circuit comprising:

a transformer having a primary winding, a feedback winding, and a secondary winding, with said secondary winding having a high voltage output;

a drive circuit for said transformer primary winding, said drive circuit having an output coupled to said primary winding and having at least one control input for selectively enabling or disabling operation of said drive circuit, said drive circuit being switchable between a first state in which current flows through said primary winding, and a second state in which substantially no current flows through said primary winding, wherein said drive circuit is operable in said first state in the absence of a disable signal on said control input and is switched into said second state in response to receiving a disable signal on said control input; and a control circuit coupled between said feedback winding and said control input of said drive circuit, said control circuit being operable to temporarily provide a disable signal on said control input following operation of said drive circuit in said first state;

wherein said control circuit comprises:

a first feedback circuit coupled to said control input of said drive circuit, said first feedback circuit being operable to generate a disable signal on said control input during operation of said drive circuit in said first state, whereby said drive circuit switches to said second state following operation of said drive circuit in said first state; and a second feedback circuit coupled between said feedback winding and said control input of said drive circuit, said second feedback circuit being operable in response to flyback energy supplied by said feedback winding to temporarily hold said drive circuit in said second state.

13. A turbine engine as defined in claim 12, wherein said first feedback circuit further comprises a comparator that is connected in circuit to receive as inputs a reference voltage and a voltage indicative of the amount of current flowing through said primary, said first feedback circuit being operable to generate its disable signal in response to the current flowing through said primary winding increasing above a selected amount.

14. A turbine engine as defined in claim 12, wherein said second feedback circuit further comprises a comparator that is connected in circuit to receive as inputs a reference voltage and a feedback signal from said feedback winding, said second feedback circuit being operable to generate its disable signal in response to the flyback energy supplied by said feedback winding.

15. A turbine engine as defined in claim 14, wherein said second feedback circuit includes a timing circuit having a resistor and a capacitor, wherein said second feedback circuit generates its disable signal for a period of time that is dependent upon the values of said resistor and said capacitor.

16. A turbine engine, comprising:

a micro-turbine engine having an igniter, and an inductive ignition circuit coupled to said igniter to provide spark energy to said igniter for use in igniting fuel within said micro-turbine engine, said inductive ignition circuit comprising:

a transformer having a primary winding, a feedback winding, and a secondary winding, with said secondary winding having a high voltage output;

a drive circuit for said transformer primary winding, said drive circuit having an output coupled to said primary winding and having at least one control input for selectively enabling or disabling operation of said drive circuit, said drive circuit being switchable between a first state in which current flows through said primary winding, and a second state in which substantially no current flows through said primary winding, wherein said drive circuit is operable in said first state in the absence of a disable signal on said control input and is switched into said second state in response to receiving a disable signal on said control input; and a control circuit coupled between said feedback winding and said control input of said drive circuit, said control circuit being operable to temporarily provide a disable signal on said control input following operation of said drive circuit in said first state;

wherein said drive circuit is operable to provide spark energy to said secondary winding by flyback of said transformer resulting from switching of said drive circuit from said first state to said second state.

17. A turbine engine as defined in claim 16, wherein said feedback winding has a first end coupled to said drive circuit to provide current to said control circuit during switching of said drive circuit from said second state to said first state, and wherein said feedback winding further includes a second end coupled to said control circuit to provide current to said control circuit during flyback of said transformer.

18. A turbine engine as defined in claim 16, wherein said feedback winding provides flyback energy to said control circuit during flyback of said transformer.

19. A turbine engine as defined in claim 18, wherein said control circuit is operable to store at least some of the flyback energy and to use the stored flyback energy to hold said drive circuit in said second state for a period of time after flyback of said transformer.

20. A turbine engine, comprising:

a micro-turbine engine having an igniter;

an inductive ignition circuit coupled to said igniter to provide spark energy to said igniter for use in igniting fuel within said micro-turbine engine, said inductive ignition circuit comprising:

a transformer having a primary winding, a feedback winding, and a secondary winding, with said secondary winding having a high voltage output;

a drive circuit for said transformer primary winding, said drive circuit having an output coupled to said primary winding and having at least one control input for selectively enabling or disabling operation of said drive circuit, said drive circuit being switchable between a first state in which current flows through said primary winding, and a second state in which substantially no current flows through said primary winding, wherein said drive circuit is operable in said first state in the absence of a disable signal on said control input and is switched into said second state in response to receiving a disable signal on said control input; and a control circuit coupled between said feedback winding and said control input of said drive circuit, said control circuit being operable to temporarily provide a disable signal on said control input following operation of said drive circuit in said first state; and a permanent magnet generator coupled to said micro-turbine engine to generate electricity during operation of said micro-turbine engine, whereby said turbine engine comprises a turbine generator.

* * * * *